US010219593B2

(12) United States Patent
Leuz

(10) Patent No.: US 10,219,593 B2
(45) Date of Patent: Mar. 5, 2019

(54) OBJECT HAVING A MOVABLE JEWELRY ELEMENT

(71) Applicant: GEBRÜDER SCHAFFRATH GMBH, Hanau (DE)

(72) Inventor: Alexander Leuz, Hanau (DE)

(73) Assignee: GEBRÜDER SCHAFFRATH GMBH, Hanau (DE)

( * ) Notice: Subject to any disclaimer, the term of this patent is extended or adjusted under 35 U.S.C. 154(b) by 0 days.

(21) Appl. No.: 15/306,669

(22) PCT Filed: Apr. 1, 2015

(86) PCT No.: PCT/DE2015/000165
§ 371 (c)(1),
(2) Date: Feb. 1, 2017

(87) PCT Pub. No.: WO2015/149746
PCT Pub. Date: Oct. 8, 2015

(65) Prior Publication Data

US 2017/0172265 A1 Jun. 22, 2017

(30) Foreign Application Priority Data

Apr. 1, 2014 (DE) ..... 10 2014 005 176
Jul. 16, 2014 (DE) ..... 10 2014 010 435

(51) Int. Cl.
*A44C 17/02* (2006.01)
*A44C 17/04* (2006.01)
(Continued)

(52) U.S. Cl.
CPC ..... *A44C 17/0283* (2013.01); *A44C 9/0061* (2013.01); *A44C 17/0275* (2013.01);
(Continued)

(58) Field of Classification Search
CPC . A44C 17/0283; A44C 17/0291; A44C 17/02; A44C 17/00; A44C 17/0258;
(Continued)

(56) References Cited

U.S. PATENT DOCUMENTS 6,226,232 B1 * 5/2001 Ruchonnet ..... A44C 17/0291 351/51
6,244,772 B1 * 6/2001 Ruchonnet ..... A44C 17/0291 401/195
(Continued)

FOREIGN PATENT DOCUMENTS

EP 1336351 B1 5/2006
EP 2510824 A1 10/2012
(Continued)

*Primary Examiner* — Emily M Morgan
(74) *Attorney, Agent, or Firm* — Lucas & Mercanti, LLP; Klaus P. Stoffel

(57) ABSTRACT

An object, such as a piece of jewelry, which has at least one precious stone supported in a recess of a main body, wherein the recess is bounded at least in some regions by a cover that is transparent at least in some regions and the at least one precious stone moves directly or indirectly on an inner peripheral wall of the recess or along an inner peripheral wall of an insert inserted into the recess.

11 Claims, 24 Drawing Sheets

(51) Int. Cl.
*G04B 47/04* (2006.01)
*A44C 9/00* (2006.01)
*A44C 25/00* (2006.01)

(52) U.S. Cl.
CPC ..... *A44C 17/046* (2013.01); *A44C 25/002* (2013.01); *G04B 47/044* (2013.01)

(58) Field of Classification Search
CPC . A44C 17/0266; A44C 9/0053; A44C 9/0061; A44C 9/0069; A44C 17/0275
USPC ..... 63/26, 31, 27
See application file for complete search history.

(56) References Cited

U.S. PATENT DOCUMENTS 6,324,868 B1 * 12/2001 Chen ..... A44C 17/0291 63/1.14
6,324,869 B1 * 12/2001 Vanlioglu ..... A44C 17/0291 63/26
6,408,647 B1 * 6/2002 Koll ..... A44C 17/0258 63/26
6,532,765 B1 * 3/2003 Hurwitz ..... A44C 17/02 63/15
7,162,891 B2 1/2007 Leuz
7,823,415 B2 * 11/2010 Gruosi-Scheufele ..... A44C 17/0291 63/15
2005/0160765 A1 * 7/2005 Hintze ..... A44C 17/0258 63/31
2008/0041102 A1 * 2/2008 Gruosi-Scheufele ..... A44C 17/0291 63/31
2016/0066662 A1 * 3/2016 Rosenberg ..... A44C 9/00 428/13
2018/0116348 A1 * 5/2018 Leuz ..... A44C 7/003

FOREIGN PATENT DOCUMENTS

FR 2757449 A1 6/1998
JP S59120106 A 7/1984
JP S6248211 U 3/1987
WO 2005110144 A1 11/2005
WO WO-2011031258 A1 * 3/2011 ..... A44C 9/0061

* cited by examiner

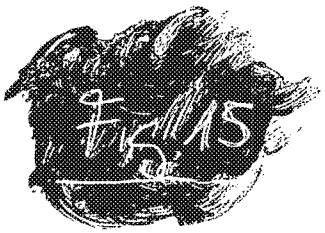
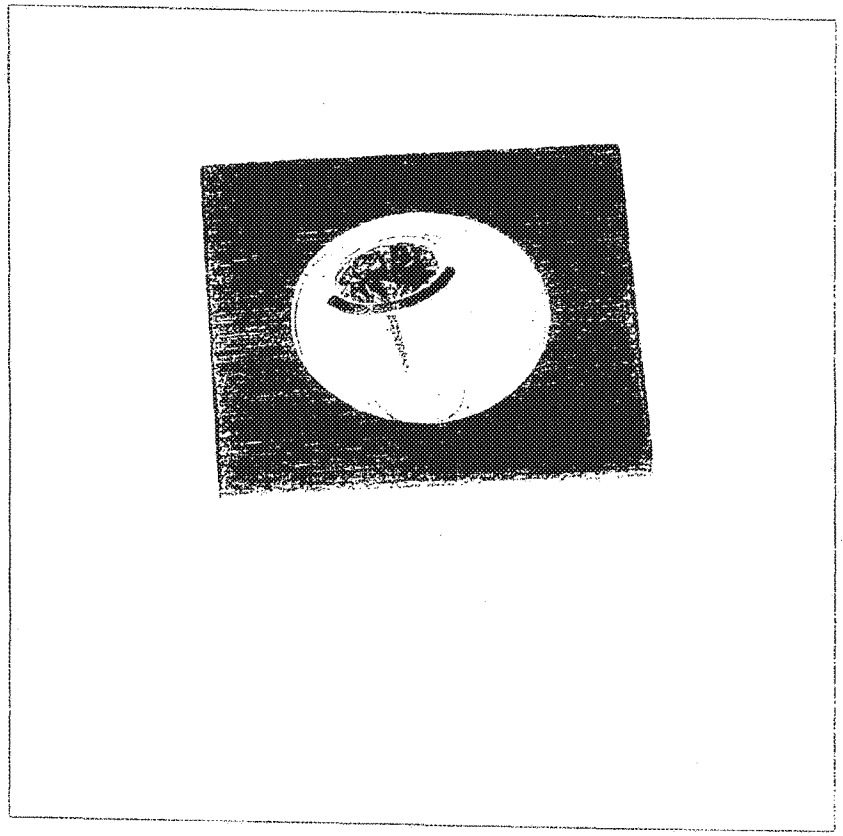
Diamond Twist | First test

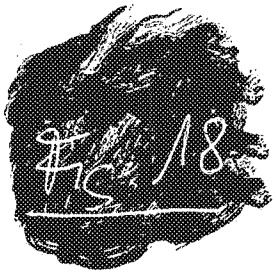
Diamond Twist / Third test video
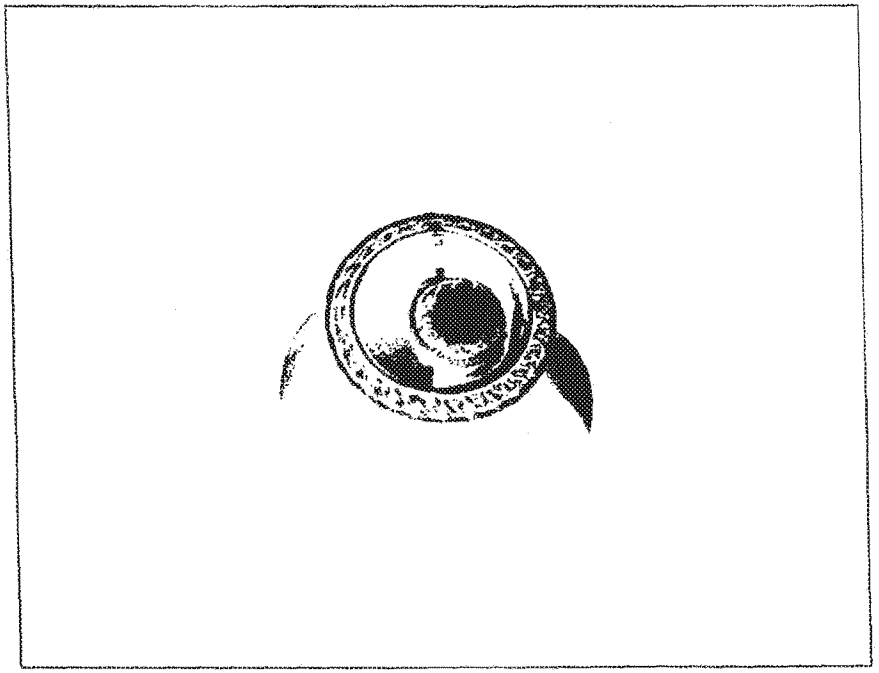
-bringing a jewelry « alive » by having a diamond turning on 360°
-3d movement and view
-play of light

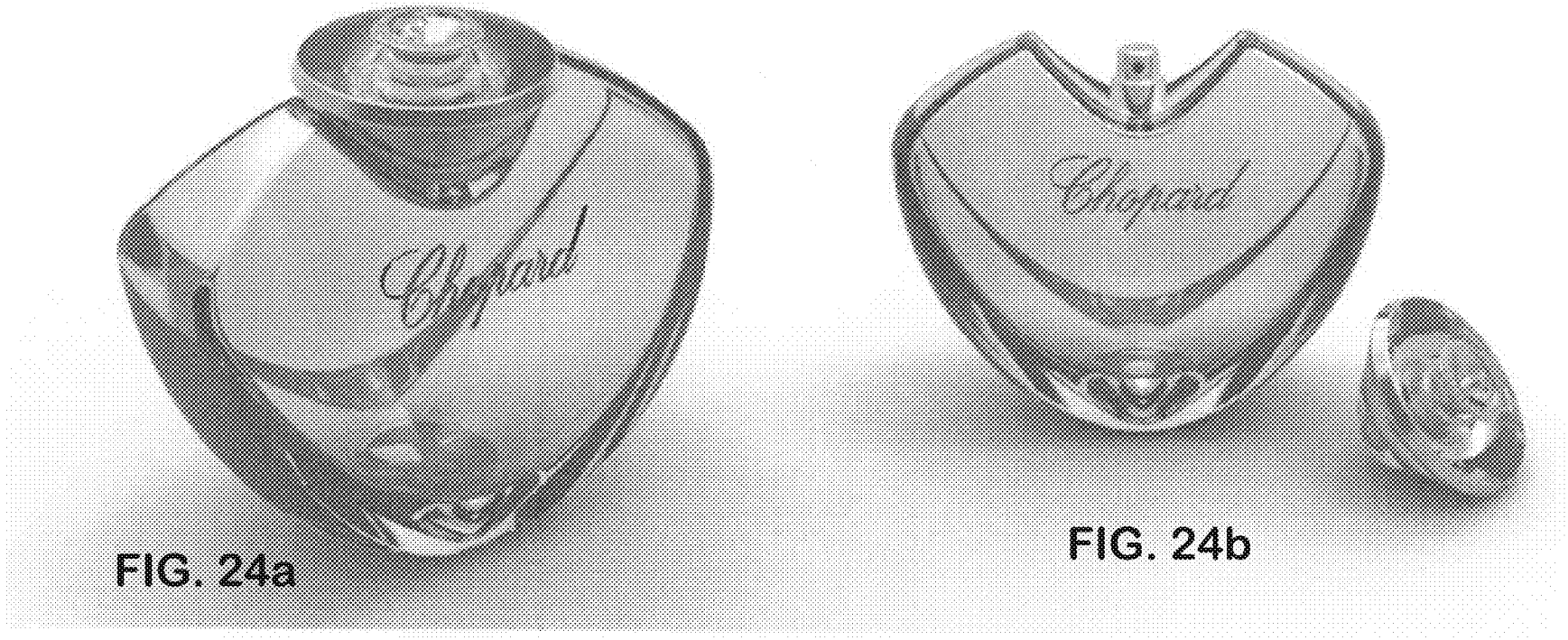
FIG. 24a
FIG. 24b
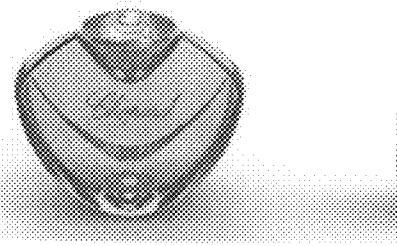
FIG. 24c
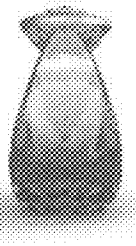
FIG. 24d
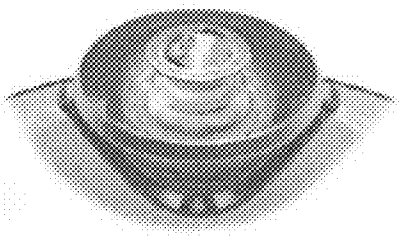
FIG. 24e FIG. 27a
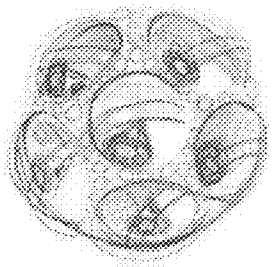
FIG. 27b
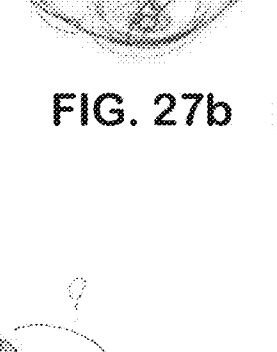
FIG. 27c
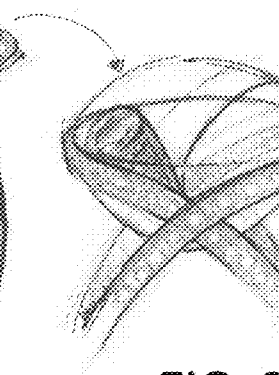
FIG. 27d
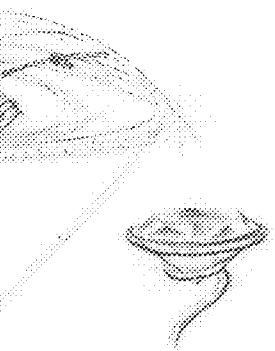
FIG. 27e
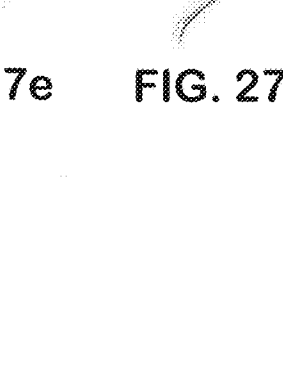
FIG. 27f
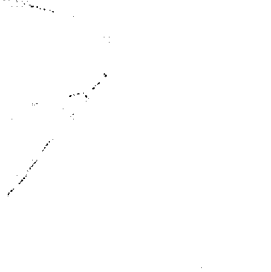
FIG. 27g
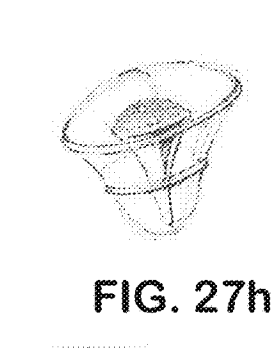
FIG. 27h
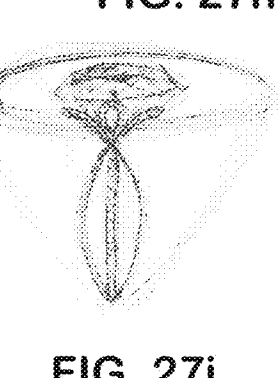
FIG. 27i
FIG. 27j

OBJECT HAVING A MOVABLE JEWELRY ELEMENT

The present application is a 371 of International application PCT/DE2015/000165, filed Apr. 1, 2015, which claims priority of DE 10 2014 005 176.5, filed Apr. 1, 2014, and DE 10 2014 010 435.4, filed Jul. 16, 2014, the priority of these applications is hereby claimed and these applications are incorporated herein by reference.

BACKGROUND OF THE INVENTION

The invention pertains to an object with at least one precious stone movably supported in a recess in a main body.

Objects of this type can be designed as pieces of jewelry, various embodiments of which are known; they can be realized as, for example, rings, bracelets, pendants, ear rings, parts of a collier, of a watch, of a pair of eyeglasses, or of a perfume flask. The jewelry pieces are typically made of a noble metal or a noble-metal alloy and hold gemstones in one or more holders. Other embodiments consist of steel, aluminum, ceramic, or other metals or alloys.

A jewelry piece which comprises at least one gemstone movably supported in a recess in a main body is known from European patent EP 1 336 351 B1. The gemstone is supported in the recess by a bow, which spans the recess and allows the stone at least to tilt around its vertical axis.

SUMMARY OF THE INVENTION

The goal of the invention is to create an object which creates an alternative movable support of a gemstone.

This goal is achieved in that at least certain regions of the recess are bounded by a cover, at least certain regions of which cover are transparent, and in that the at least one gemstone moves directly or indirectly along an inner peripheral wall of the recess or on an inner peripheral wall of an insert set into the recess.

In the case of an object according to the invention with at least one gemstone movably supported in a recess in a main body, the recess is closed off by a transparent cover, and, when the jewelry piece is moved, the at least one gemstone rolls along an inner peripheral wall of the recess or on an inner peripheral wall of an insert set into the recess.

As a result of the rolling movements of the at least one gemstone which occur when the object moves, the position of the at least one gemstone changes relative to the main body and thus assumes a different orientation to the incident light. Because the gemstone is exposed to the incident light over its entire length, striking optical results and effects can be obtained.

Especially in the case of diamonds or precious stones or other facetted bodies, the sparkling and glittering of the light is supported to perfection, resulting in many different nuances. This is especially true when the inner peripheral wall of the recess or that of the insert has a mirror surface, so that the at least one gemstone is backlit, as it were. When an insert is used, this forms a liner and can be made of a material different from that of the main body in the area of the recess. In particular, the insert consists of a metallic or glassy material.

To prevent the at least one gemstone from forcefully striking the cover when the jewelry piece is moved, it is advantageous for the at least one gemstone to be supported in such a way that there is no gap and thus only the minimum possible clearance between the base of the recess or the base of the insert and the cover.

It can be ensured that the at least one gemstone will roll easily around 360° of the inner peripheral wall in both directions if the at least one gemstone and the inner peripheral wall are both conical.

In an alternative exemplary embodiment, the inner peripheral wall, furthermore, has a convex curvature. When the outer peripheral wall of the gemstone is straight, there will then be only a small contact area, in particular a tangential contact area, between the at least one gemstone and the inner peripheral wall, as a result of which even the slightest movements of the gemstone will cause the gemstone to execute rolling movements.

To intensify the optical effects when light falls on the object, at least one decorative element such as another gemstone, an inscription, a metallic inlay, or the like can be set at least into the inner peripheral wall and/or into a contact surface for the cover.

To prevent damage to the edge area of the cover, it is advantageous for the cover to be inset into a radial expansion of the recess or of the insert.

In one exemplary embodiment, a transition surface is formed between the inner peripheral wall and the radial expansion.

The transition surface is preferably a plateau-like annular surface and can be used to achieve additional optical effects. For example, the transition surface can also be provided with at least one decorative element such an additional gemstone, an inscription, or metallic inlay or the like.

The cover is preferably an optical glass body. As a result, the cover can be angled in such a way that the optical effect of the moving gemstone and/or of the at least one additional decorative element can be seen in its pure, undistorted form. Alternatively, the cover can be angled in such a way that the optical effects of the at least one gemstone and/or of the at least one other decorative element are changed.

As an alternative to the realization of the object provided with the movably supported gemstone as a piece of jewelry, it is also possible that the object could be realized as an article of daily use. In particular, it is possible that the object could be configured as a vase, as a handbag, as an article of clothing, as a shoe, or as a beauty shop article.

The cover with at least certain transparent regions can, for example, be a flat or curved glass disk. It is also possible, however, that the transparent properties of the cover could be achieved not by the selection of the material itself but rather by the geometric design of the cover. For example, grid-like or mesh-like covers are also subsumed under the concept of a structure with at least certain transparent regions. The transparent properties are provided here by the gaps between the structures forming the grid or mesh.

In cases of a design of a cover of this type, in which the material is not in itself transparent and the property of transparency in at least certain regions is created by one or more openings in this material, it is possible in particular to arrange the openings in the regions of the cover which are not intended for direct contact with the gemstone and which therefore do not serve to limit the potential range of movement of the gemstone.

Various other advantageous exemplary embodiments of the invention are the objects of the subclaims.

Preferred exemplary embodiment of the invention are explained in greater detail below on the basis of schematic diagrams:

BRIEF DESCRIPTION OF THE DRAWING

FIG. 15 shows an embodiment in which the jewelry piece is configured as a ring;

FIG. 18 shows another modification of what is shown in FIGS. 11 and 12;

FIGS. 24*a*-24*e* show arrangements of the movable mounting element in the area of perfume bottles;

FIGS. 27*a*-27*j* show additional design variants of FIG. 21;

DETAILED DESCRIPTION OF"THE INVENTION

Figure 1:
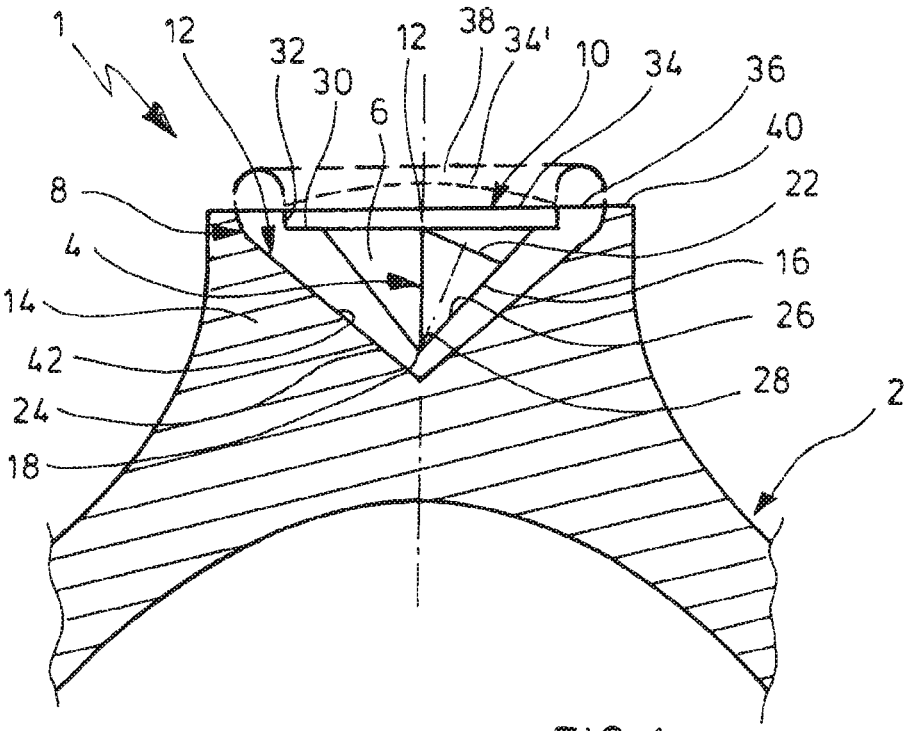
FIG. 1 shows a partial cross section through a first exemplary embodiment of a decorative ring according to the invention and through variants of the first exemplary embodiment.
Figure 2:
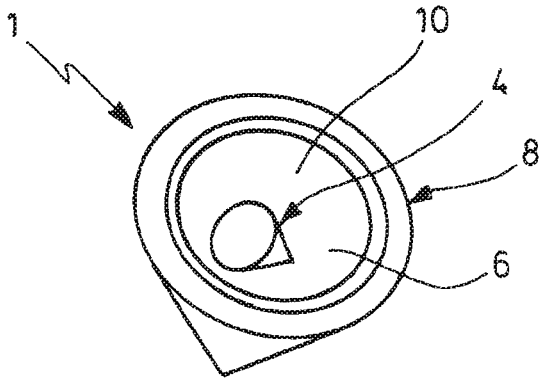
FIG. 2 shows a perspective diagram of an insert of FIG. 1 provided with a gemstone.

According to a first exemplary embodiment according to the invention shown in FIGS. 1 and 2, a jewelry piece 1 is designed as a finger ring with a ring-shaped main body 2, which is provided with a gemstone 4. The gemstone 4 is movably supported in a seating space 6 of an insert 8, which space is closed off by a transparent disk 10. The insert 8 is set into a recess 12, which is provided in the outside periphery of a thickened area 14 of the main body 2.

The gemstone 4 in the exemplary embodiment shown here is a rotationally symmetric cone. It has a conical peripheral wall 16 which forms a tip 18 at the base and continues upward by way of a circumferential edge 20 to an end surface 22 at the top. The end surface 22 in the exemplary embodiment shown here is flat, but it can also be provided with elevations, depressions, and/or facets.

The insert 8 forms a liner for the gemstone 4 and preferably consists of a metal, a metal alloy, or a glass. In the exemplary embodiment shown, it is a rotationally symmetric, conical body with a conical outer contour, which forms the seating space 6. It has a conical outer peripheral wall 24 and a conical inner peripheral wall 26, which forms a base 28; from this base, the inner wall extends upward to a radial expansion formed as an annular surface 30, which surrounds the inner peripheral wall 26 and which serves to receive the disk 10.

The inner peripheral wall is preferably configured to reflect light, i.e., to act as a mirror. The annular surface 30 continues in turn to form a cylindrical inner peripheral surface 32, which forms the radial boundary of the expansion. Instead of a conical outer peripheral wall 24, the insert 8 could also have a convex, cylindrical, or other similar type of outer peripheral wall 24.

The disk 10 consists preferably of optical glass it is permanently mounted in the expansion and is in contact with the annular surface 30 and the inner peripheral surface 32, which in this case form contact surfaces 30, 32. In the exemplary embodiment shown, it has a constant thickness, and its top surface 34 is flush with an annular end surface 36 of the insert 8, which surrounds it. As indicated by the broken lines, however, the disk 10 can also be surrounded by a circumferential bead 38 of the insert 8. In addition, the disk 10 could have a concave top surface 34', as indicated by the crossed line by way of example, or be ground in some other way.

The recess 12 is introduced into a plateau surface 40 of the thickened area 14 and has an inner peripheral wall or inside wall 42 corresponding to the outer peripheral wall 24 of the insert 8. The insert 8 is permanently mounted in the recess 12, an adhesive, for example, being used to bond its outer peripheral wall 24 to the inner wall 42 of the recess. If the insert 8 for example, a cylindrical or convex outer peripheral wall 24, it can also be pressed into the inside wall 42 of the recess or connected to it mechanically.

The peripheral wall 16 of the gemstone 4 rests over its entire length against the inner peripheral wall 26 and, depending on the orientation of the insert 8 and thus depending on the positioning of the jewelry piece 1, there is almost no gap between its tip 18 and the base 28 or between its edge 20 and the disk 10. When the jewelry piece 1 is moved, the gemstone 4 rolls 360° around the inner peripheral wall 26 of the insert 8. The direction of movement is determined by the direction in which the gemstone 1 is moved. Because there is almost no gap between the gemstone 4 and the disk 10 or the base 28, the gemstone 4 cannot forcefully strike the disk 10, for example, when the jewelry piece 1 is moved, which would subject to the disk 10 and the gemstone 4 to the force of impact.

When the orientation of the insert 8 is vertical or only slightly tilted, the tip 18 of the gemstone 4 rests on the base 28, and there is a minimal gap between the top of the stone and the disk 10. When the orientation of the inner peripheral wall 26 is horizontal or between the horizontal and an upside-down orientation of the insert 8, the edge 20 of the gemstone 4 rests on the disk 10, and there is a minimal gap between the tip of the stone and the base 28.

Figure 3:
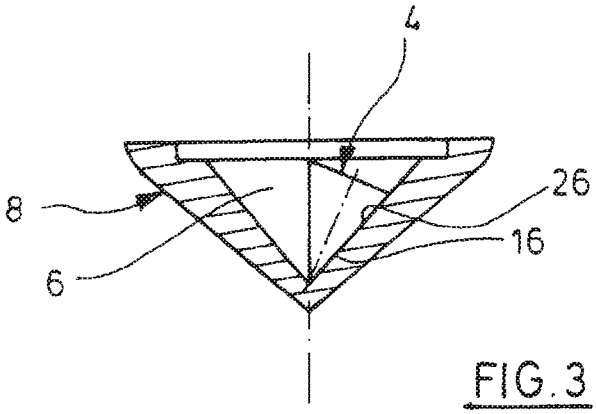
FIG. 3 shows a cross section through an insert of another exemplary embodiment according to the invention provided with a gemstone.

In contrast to the preceding example according to FIGS. 1 and 2, the inner peripheral wall 26 of the insert 8 in the exemplary embodiment shown in FIG. 3 is not only conical but also convex and thus curves outward into the seating space 6. As a result, only part of the peripheral wall 16 of the gemstone 4, not its entire length, rests against the inner peripheral wall 26, as a result of which the gemstone 4 tends to roll upon even the slightest movement of the jewelry piece 1.

Figure 4:
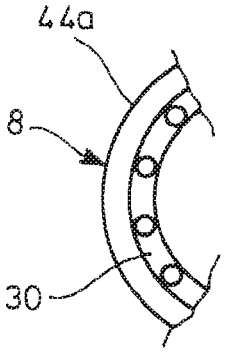
FIG. 4 shows a partial top view of an insert according to another exemplary embodiment according to the invention.
Figure 5:
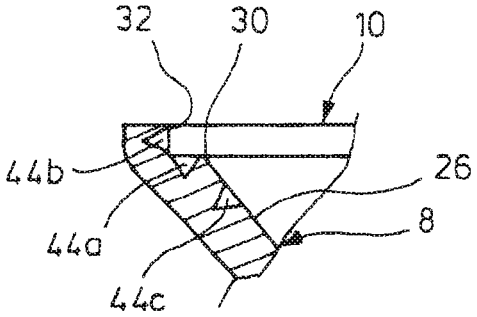
FIG. 5 shows a partial cross section through an insert according to another exemplary embodiment according to the invention.

As shown in FIGS. 4 and 5, additional decorative elements 44*a*, 44*b*, 44*c* such as additional gemstones, inscriptions, metal inlays, and the like can be set into the annular surface 30, into the inner peripheral surface 32, and into the inner peripheral wall 26. To ensure the optimal mounting of the disk 10, the decorative elements 44*a*, 44*b* are flush with the annular surface 30 and with the inner peripheral surface 32 and/or are set back from them. Of course, depressions (not shown) in the disk 10 can also be provided, so that decorative elements 44*a*, 44*b*, can be introduced into these areas. So as not to interfere with the rolling movement of the gemstone 4, the decorative elements 44*c* are flush with the inside peripheral wall 26 and/or are set back from it.

Figure 6:
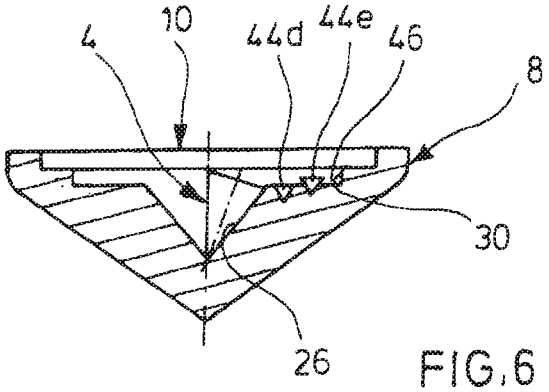
FIG. 6 shows a cross section through an insert equipped with a gemstone according to another exemplary embodiment according to the invention.

In contrast to the preceding inserts according to FIGS. 1, 2, and 3, an insert 8 shown in FIG. 6 has a transition surface 46, which is formed between the conical inner peripheral surface 26 and the annular surface 30. The transition surface 46 is a certain distance away from the disk 10 and, in the exemplary embodiment shown here, is configured as a flat annular surface. It can also comprise decorative elements 44*d*, 44*e*. Because of the distance between them and the disk 10, the decorative elements can project from the transition surface 46, as indicated by the reference number 44*e*.

What is disclosed is a jewelry piece which has at least one gemstone supported in a recess in a main body, wherein the recess is closed off by a transparent disk and the at least one gemstone rolls along an inner peripheral wall of the recess or along an inner peripheral wall of an insert set into the recess.

The transparent cover 10 has been described above several times as a disk in a preferred embodiment. This, however, does not limit the design of the cover 10 to a plate-like or flat structure. In particular, it is also possible that the cover 10 could be designed with a dome-like curvature. The geometry of the dome-like curvature is adapted here to the rolling movement of the gemstone in such a way that a sufficiently large interior space is available. According to the embodiment of FIG. 7, the gemstone 4 is arranged in a holder. The holder is designed to be similar to a hollow cone, the interior space of which accommodates a certain part of the gemstone 4. By adapting the angle between the outer surface of the holder and the center line of the holder to the angle between the peripheral wall 16 and the vertical direction, a direct and controlling influence can be exerted on the rolling movement.

According to the embodiment in FIG. 1, the opening angle of the cone-like holder is the same as the opening angle of the seating space 6. In principle, the corresponding angles can also be different from each other.

In the previously described embodiments, the seating space 6 of the insert 8 has usually been closed off by a transparent disk 10. According to a modified embodiment, the seating space 6 is closed off by a disk 10 only in the areas which are intended to make contact with the gemstone 4. For example, the sides of the disk 10 can be held by webs or projections in such a way that free spaces remain between these webs or projections.

In embodiments not involving the use of an insert 8, it is possible for the disk 10 to close off the recess 12 completely, or, here again, it is also possible for the disk 10 to close off only part of the recess 12, i.e., in the areas which are intended to make contact with the gemstone 4.

Figure 9:
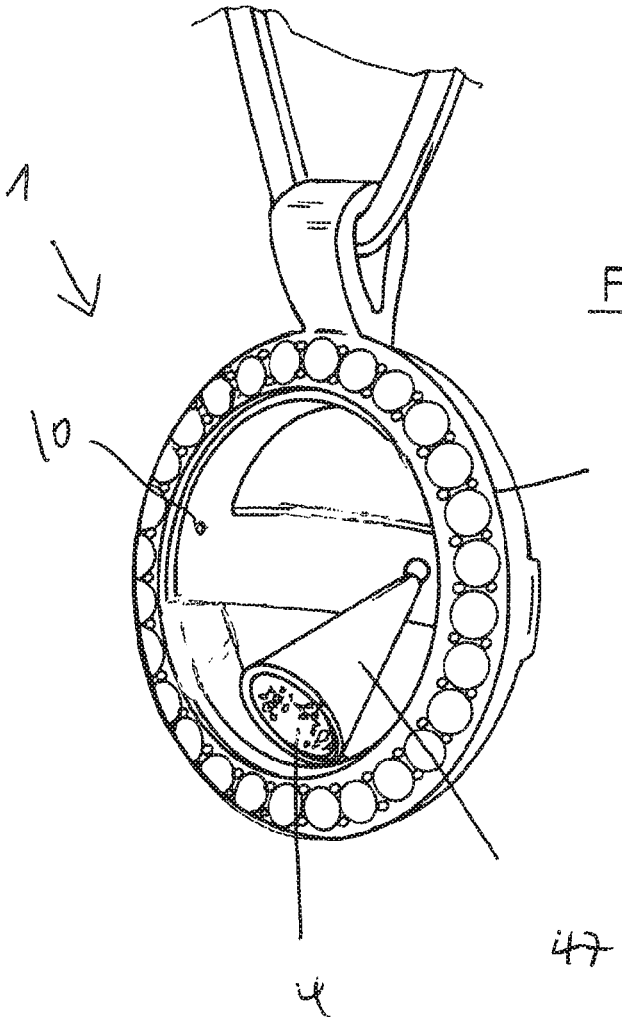
FIG. 9 shows the mounting element according to FIG. 7 with a gemstone, integrated into a medallion.

FIG. 9 shows an embodiment in which the jewelry piece 1 is designed as a pendant. The insert 8 here is conical in shape, and the tip 60 of the cone is guided in an opening 61 in a transverse web 62. In the exemplary embodiment shown, the pendant comprises a rim 63, which holds the disk 10. Additional gemstones can be arranged in the area of the rim 63.

Figure 10:
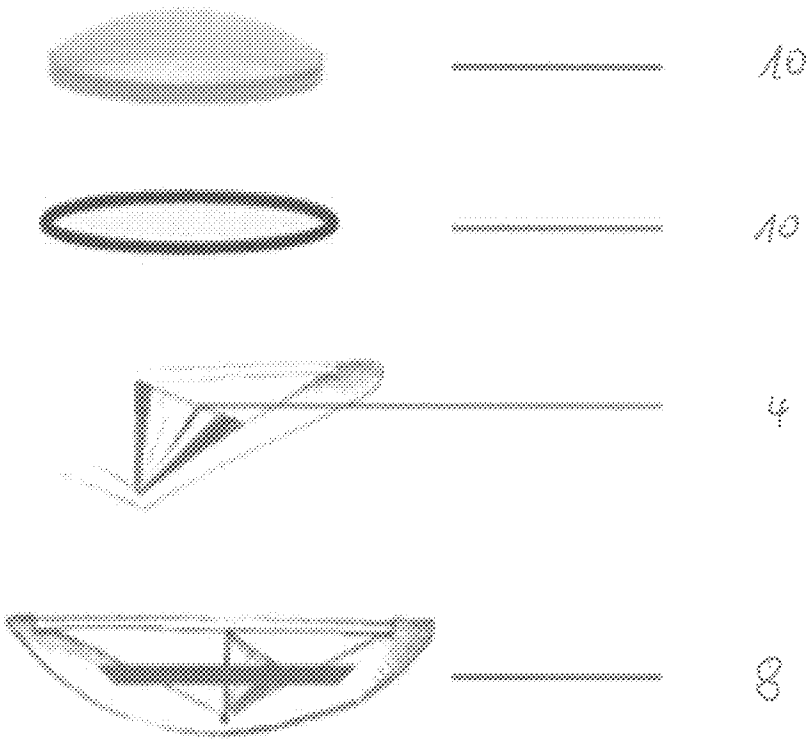
FIG. 10 shows the mounting element with gemstone and two variants of a transparent cover.

FIG. 10 shows a diagram similar to an exploded view to illustrate another exemplary embodiment. The insert 8 comprises here a dish-like outer contour. The disk 10 has a domed contour. As material for the disk 10, it is possible to use sapphire glass, for example. FIG. 10 also illustrates a different embodiment of the disk 10.

A corresponding flat design of the disk 10 can also be realized with the use of sapphire glass. The disk 10 can be attached to the insert 8 by means of an adhesive, for example.

Figure 11:
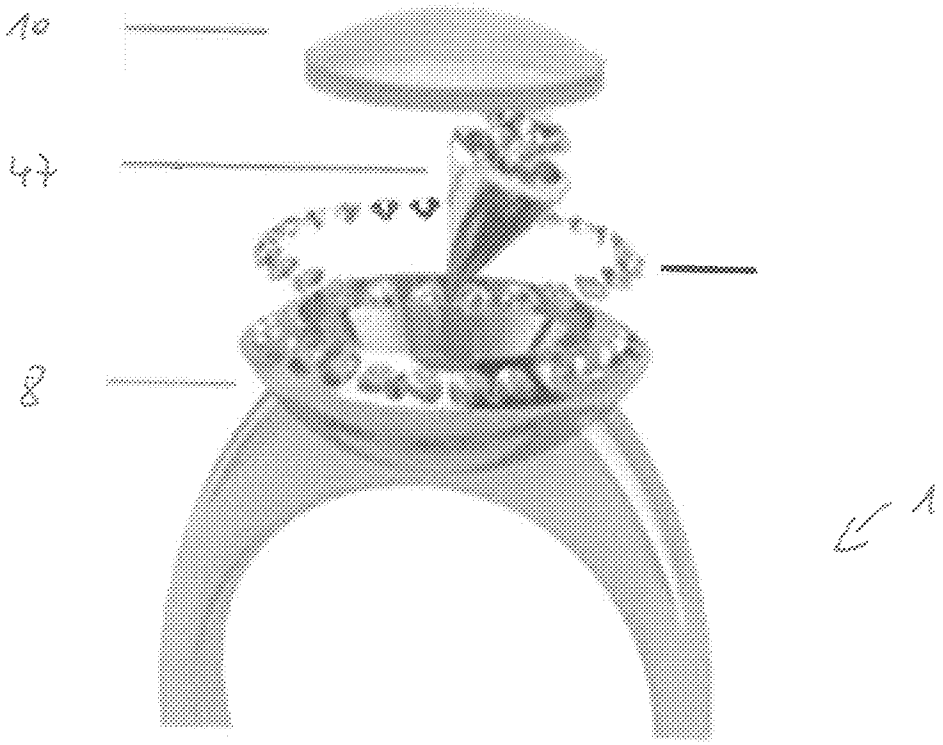
FIG. 11 shows the mounting element with gemstone in an arrangement in the area of a ring.

FIG. 11 shows an embodiment in which the jewelry piece 1 is designed as a ring. The insert 8 has here a dish-like outer contour and is provided with a plurality of decorative elements in the area of the rim. Filler stones or engravings, for example, can be used as decorative elements. One or more gemstones 4 can be positioned in the area of the insert 8.

Figure 12:
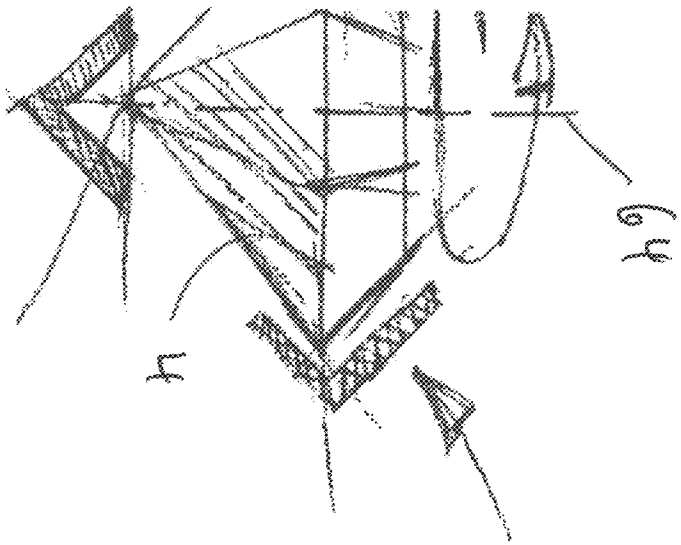
FIG. 12 shows a simplified diagram in illustration of a movable holder for the gemstone.

FIG. 12 is a highly simplified diagram which illustrates a possible retention principle for the movable support of the gemstone 4. The essential point is that the gemstone 4 is arranged in a holder which limits its movement in the direction of its long axis 64 but allows the stone to move around the long axis 64; it can, for example, execute rotational and/or tipping movements.

Figure 13:
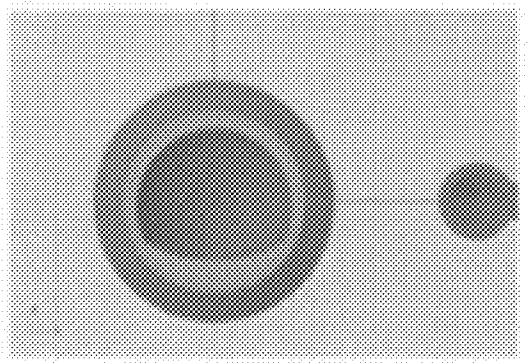
FIG. 13 shows a variant with an offset center of the liner.

FIG. 13 shows another embodiment. When the gemstone is oriented more-or-less vertically, the insert 8 can be optimized in the form of a liner. This is an especially effective way to support the rolling movement of the gemstone 4. According to the embodiment in FIG. 13, a contact surface is created, which makes it possible for a conical insert 8 to roll back and forth on this surface. A displacement of the center and a special configuration of the contact surface can produce specific rolling effects and determine the distance which the conical insert 8 can travel.

Figure 14:
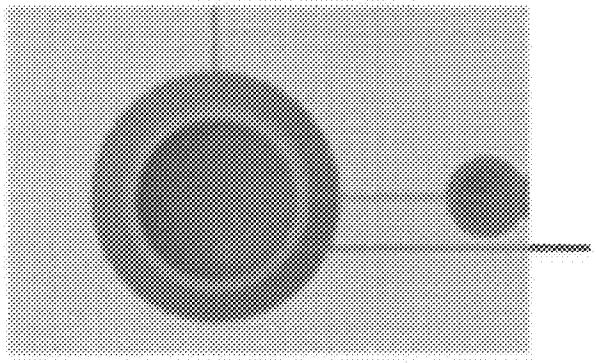
FIG. 14 shows a modification of FIG. 13.

In the embodiments according to FIGS. 13 and 14, the liner is used in the area of, for example, a chain pendant or an ear ring. This means that the viewing direction into the liner is essentially horizontal. Thus the liner is provided with a convexly curved inner boundary surface, on which the gemstone or a mounting holding the gemstone can roll; when seen in the given viewing direction, it can roll from left to right and back again.

According to the embodiment in FIG. 14, the configuration of FIG. 13 shows another modification. The center of the conical insert 8 is shifted asymmetrically. As a result, the position of the conical insert 8 is changed, so that the rolling effect is limited. A rolling movement therefore occurs only in the lower part. The displacement of the center prevents the cone from tipping.

The transparent cover 10 has been described several times above as a disk in a preferred embodiment. This does not, however, limit the design of the cover 10 to a plate-shaped or flat structure. In particular, it is also possible that the cover 10 could be configured with a dome-like curvature. The geometry of the dome-like curvature is adapted to the rolling movement of the gemstone in such a way that a sufficiently large interior space is provided.

Figure 7:
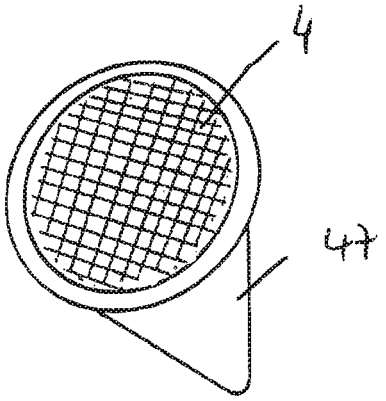
FIG. 7 shows a perspective view of the hollow conical mounting element 8 with a gemstone set into it.
Figure 8:
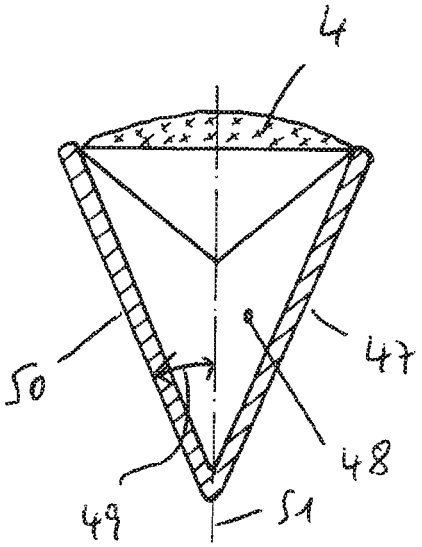
FIG. 8 shows a vertical cross section through the mounting element according to FIG. 7 with a gemstone.

According to the embodiment in FIGS. 7 and 8, the gemstone 4 is arranged in a holder 47. The holder is designed to be similar to a hollow cone, the interior space of which accommodates a certain part of the gemstone 4. By adapting the angle 49 between the outer surface of the holder and the center line 41 of the holder 47 to the angle 49 between the peripheral wall 16 and the vertical direction, a direct and controlling influence can be exerted on the rolling movement.

According to the embodiment in FIG. 1, the opening angle of the cone-like holder is the same as the opening angle of the seating space 6. In principle, the corresponding angles can also be different from each other.

In principle, the outside surfaces of the gemstones 4 provided for the execution of the rolling processes can have the conical contour visible in FIG. 1 and can roll along conically bounded inner surfaces of the seating spaces 6 in all of the embodiments described here. In principle, however, the two cooperating outside contours can assume almost any other shape.

According to a typical embodiment, it is the goal to allow the movements of the gemstones 4 to proceed continuously. This type of movement is supported by continuously) curved surfaces. Alternatively to conical designs, it would also be possible to use, for example, curved surfaces in the form of segments of a sphere, oval designs, or curves with some other type of contour.

According to special embodiments, however, it can also be the goal to achieve a discontinues course of movement, which is achieved by means of surface contours which discontinues curvatures. For this purpose, it would be possible to use angular structures, projections, or recesses in the area of the surfaces which slide along each other.

Figure 16:
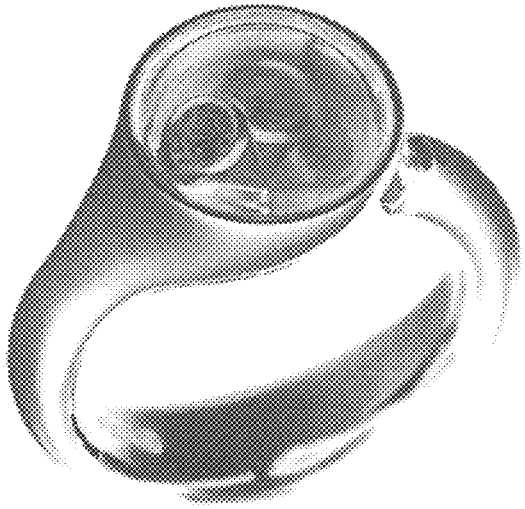
FIG. 16 shows a diagram representing a modification of FIG. 15.

FIG. 15 shows another variant in which the jewelry piece 1 is designed as a ring. The embodiment according to FIG. 16 also shows a design of the jewelry piece as a ring; here two conical inserts 8, each with a gemstone 4, are arranged underneath the transparent disk 10.

Figure 17:
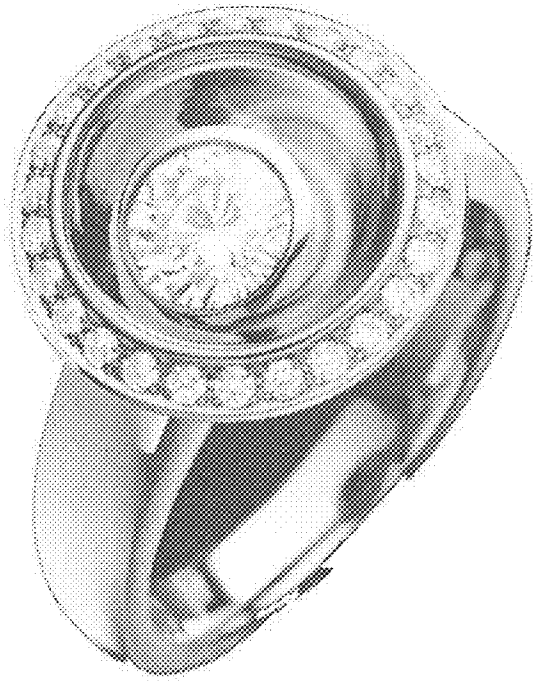
FIG. 17 shows diagram of a modification of a configuration of the jewelry piece as a ring.
Figure 19C:
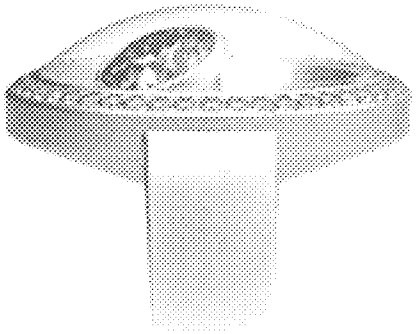
FIGS. 19*a*-19*f* show additional variants of rings with a movable mounting element, wherein the mounting element is movably arranged in a mounting depression with a transparent, cap-like cover.
Figure 19B:
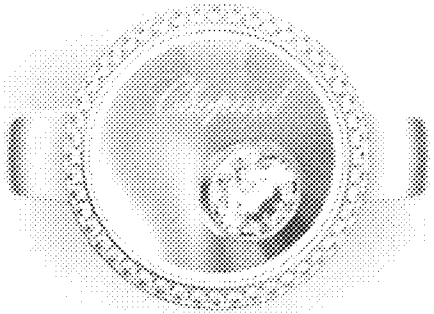
Figure 19A:
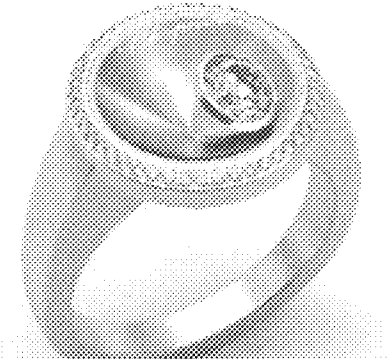
Figure 19F:
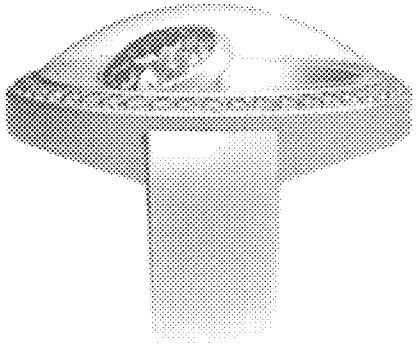
Figure 19E:
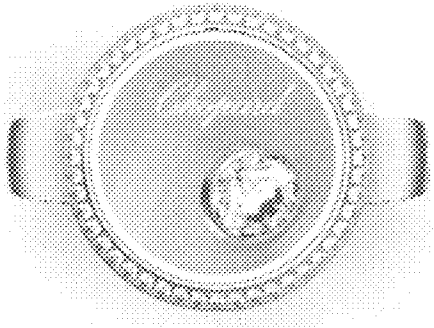
Figure 19D:
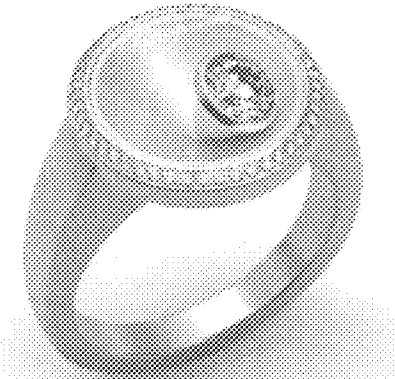
Figure 20B:
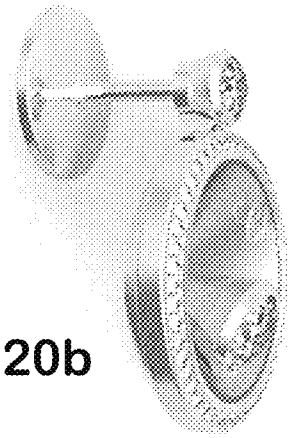
FIGS. 20*a*-20*d* show variants of the embodiments of FIG. 15 with an arrangement of the mounting element in the area of ear rings or ear studs instead of in the area of a ring.
Figure 20D:
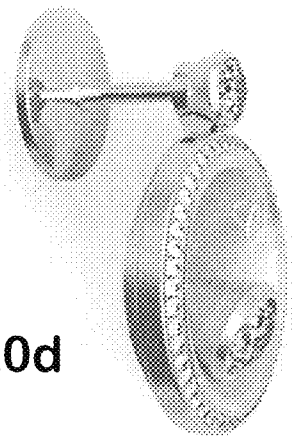
Figure 20A:
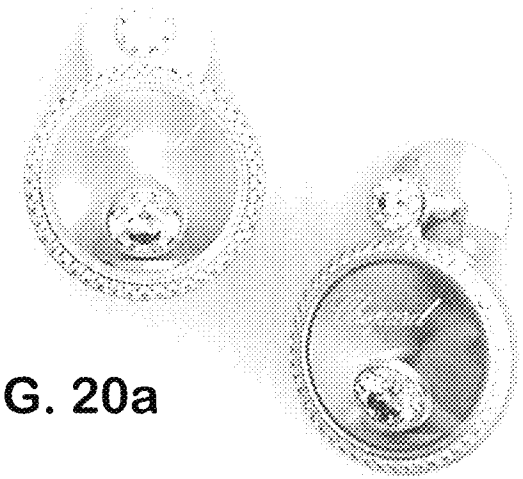
Figure 20C:
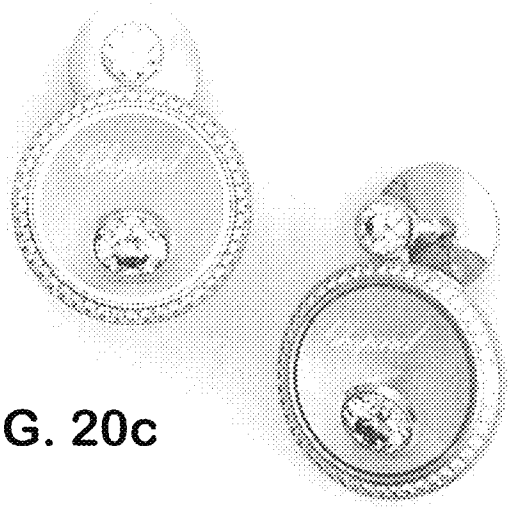
Figure 21A:
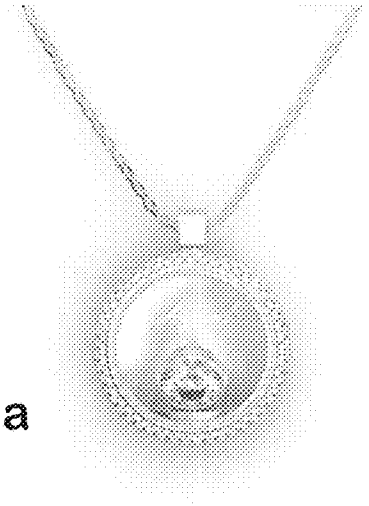
FIGS. 21*a*-21*d* show modified variants of arrangements of the mounting element in the area of chain pendants.
Figure 21B:
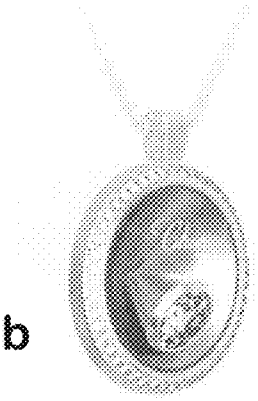
Figure 21C:
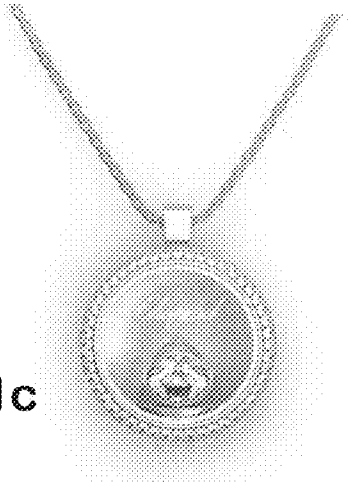
Figure 21D:
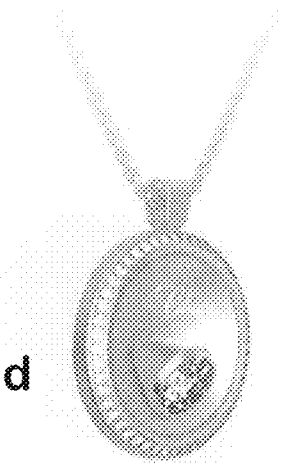
Figure 22A:
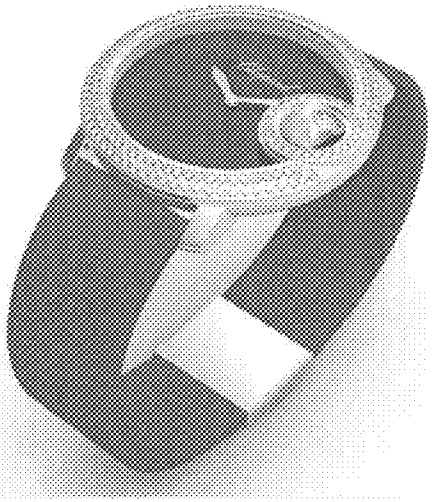
FIGS. 22*a*-22*d* show additional design variants with an arrangement of the movable mounting element in the area of watches.
Figure 22B:
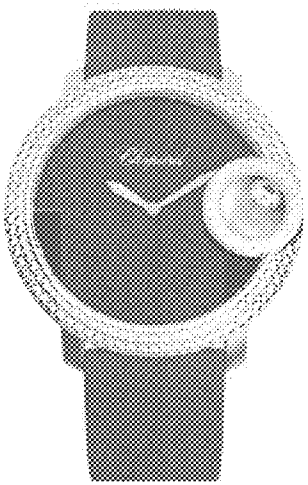
Figure 22C:
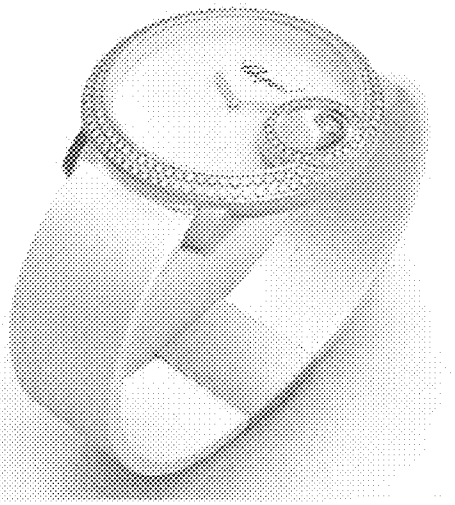
Figure 22D:
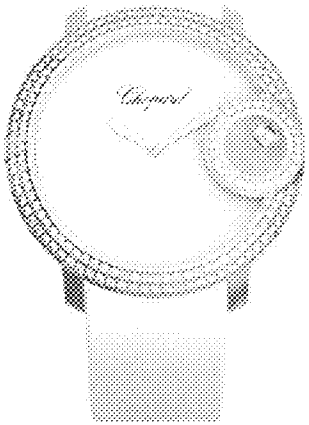

Each of FIGS. 17 and 18 also shows an embodiment with a jewelry piece 1 configured as a ring. In each of these variants, a conical insert 8 with a gemstone 4 is arranged underneath the disk 10. In the area of the rim surrounding each disk 10, it is possible to position a plurality of additional gemstones, which can be mounted in a stationary or movable manner.

FIG. 19 again shows various additional embodiments, from different perspectives, of configurations of the jewelry piece 1 as a ring, wherein in each case an insert 8 with a gemstone 4 is arranged under a dome-like disk 10. Here, too, decorative elements in the form of additional gemstones or engravings, for example, are provided in the area of the rim surrounding the disk.

Additional jewelry pieces 1, intended for a suspended arrangement, are shown in FIG. 20. Here, too, an insert 8 with a gemstone 4 is located under the disk 10.

Comparable configurations are also illustrated in FIG. 21. The medallion-like pendants realized here are intended to be worn on a chain, for example.

Figure 23B:
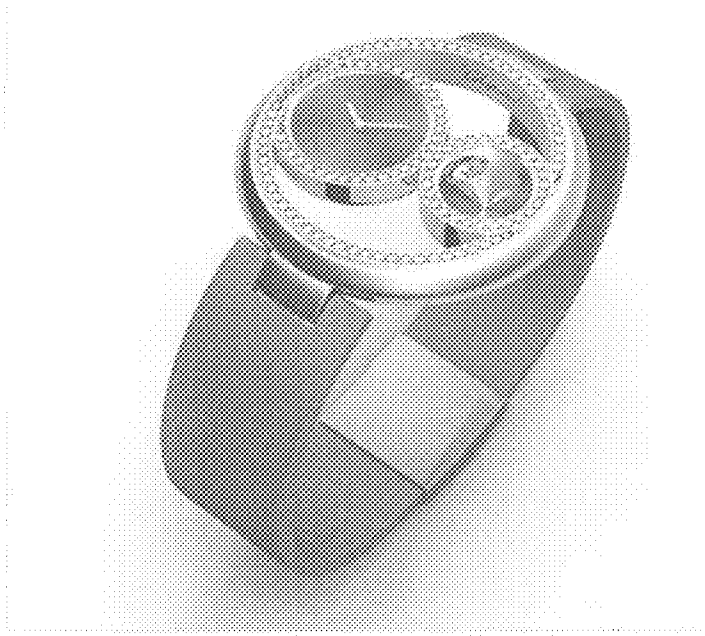
FIGS. 23*a*-23*b* show additional variants of the configurations according to FIG. 17.
Figure 23A:
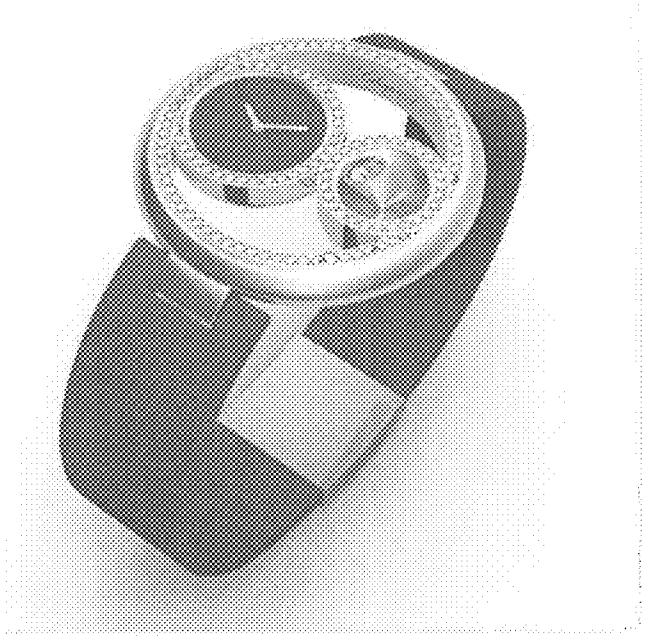
Figure 25C:
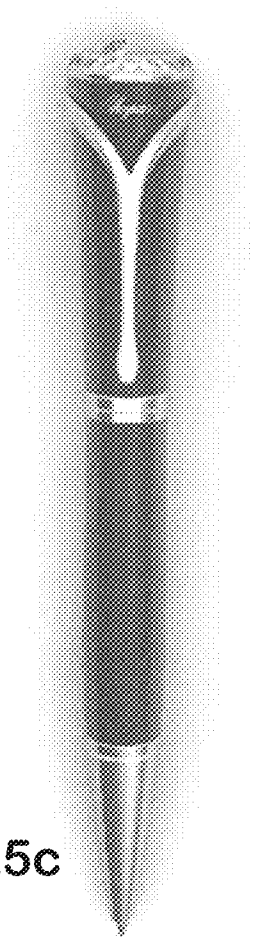
FIGS. 25*a*-25*d* show design variants with an arrangement of the movable mounting element in the area of writing instruments.
Figure 25B:
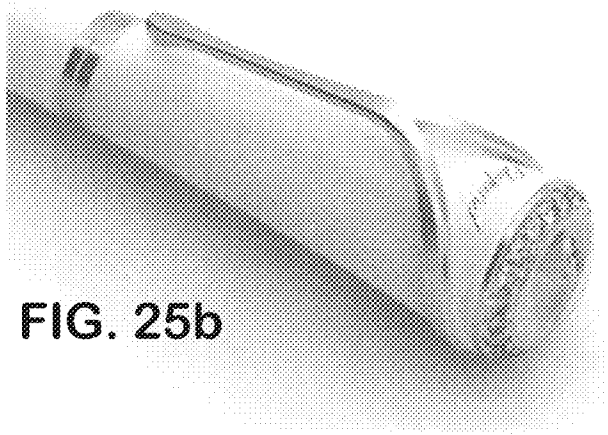
Figure 25D:
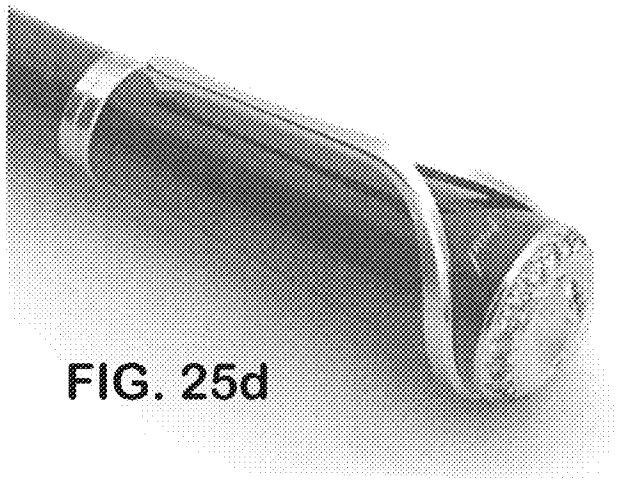
Figure 25A:
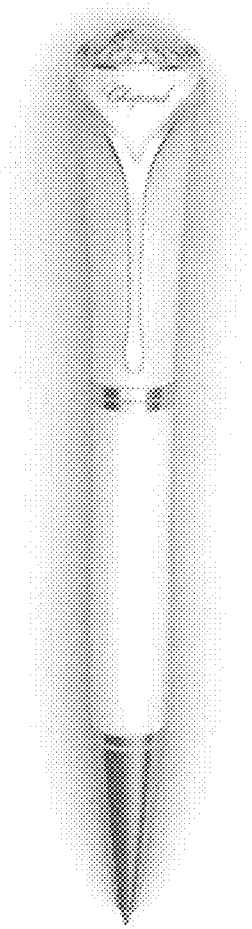

FIGS. 22 and 23 show configurations of the jewelry piece 2 as a watch. Both with respect to the arrangement of the hands of the watch and also the arrangement of the insert 8 with the transparent disk 10 and the gemstone, which either is held in a holder 47 or rolls directly on the insert 8.

According to the embodiments in FIG. 24, the insert 8 is arranged in the area of a perfume bottle. In the exemplary embodiment shown here, this is done in the area of a stopper of the perfume bottle.

According to the embodiment in FIG. 25, the insert 8 is arranged in a writing instrument. What is preferred here is the upper end of the writing instrument, such as a pen.

Figure 26B:
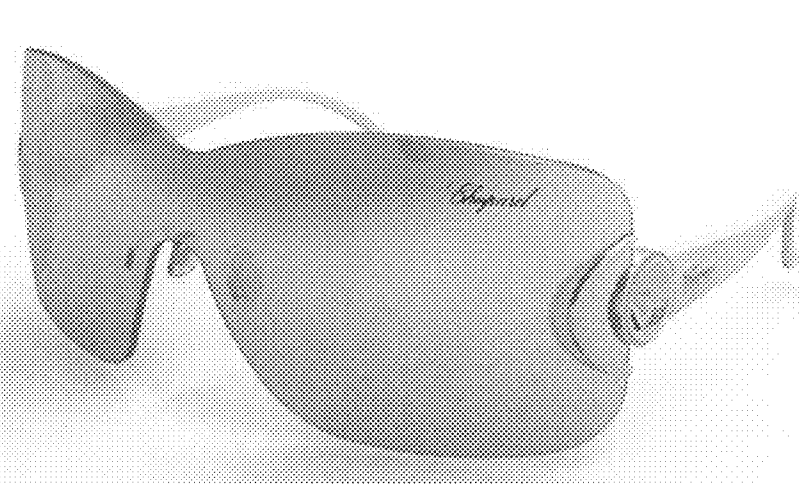
FIGS. 26*a*-26*b* show variants of the arrangement of the movable mounting element in the area of eyeglasses.
Figure 26A:
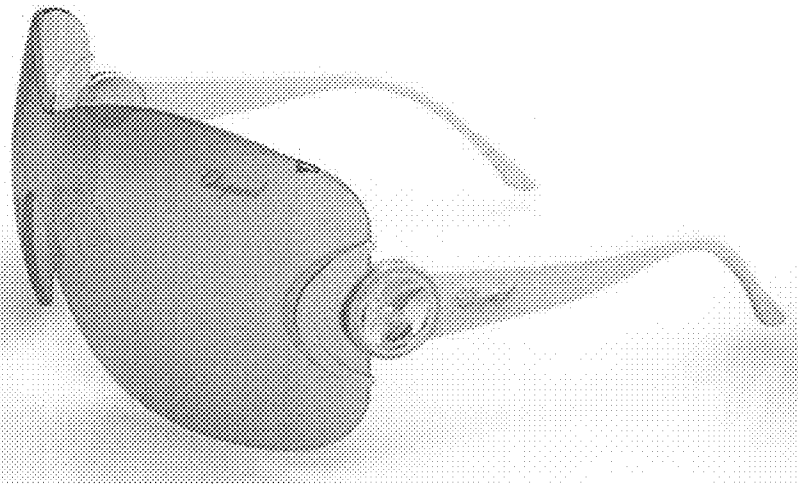

FIG. 26 shows the arrangement of the insert 8 as a decorative element on a pair of eyeglasses.

FIG. 27 illustrates again the arrangement of movably supported gemstones in rings or pins.

Figure 28:
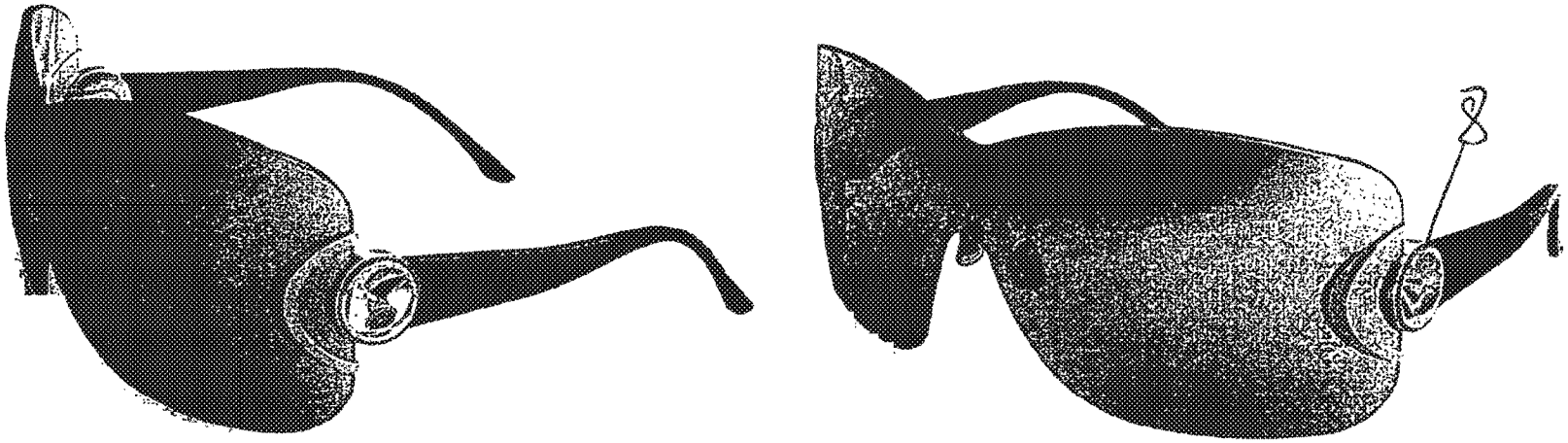
FIGS. 28*a*-28*b* show additional design variants with a movably arranged mounting element.

FIG. 28 shows again an arrangement of the insert 8 as a decorative element on a pair of eyeglasses.

Figure 29A:
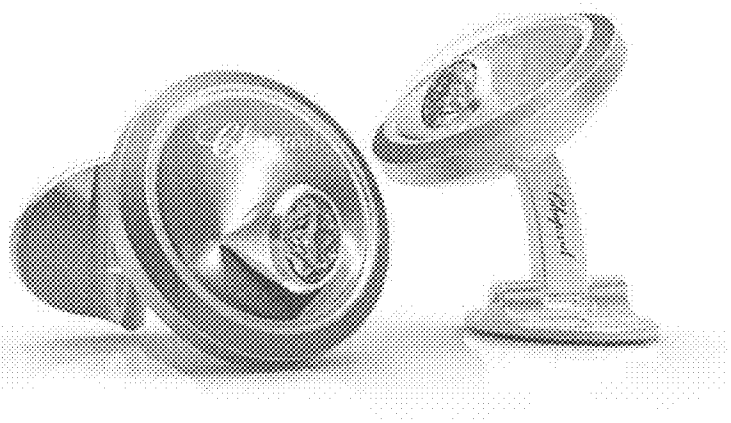
FIGS. 29*a*-29*b* show various additional sketches of additional design variants.
Figure 29B:
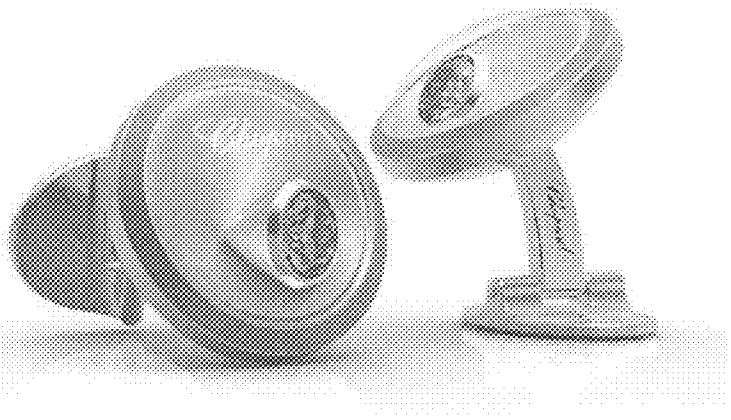
Figures 30A, 30B, 30C, 30D, 30E, 30F, 30G:
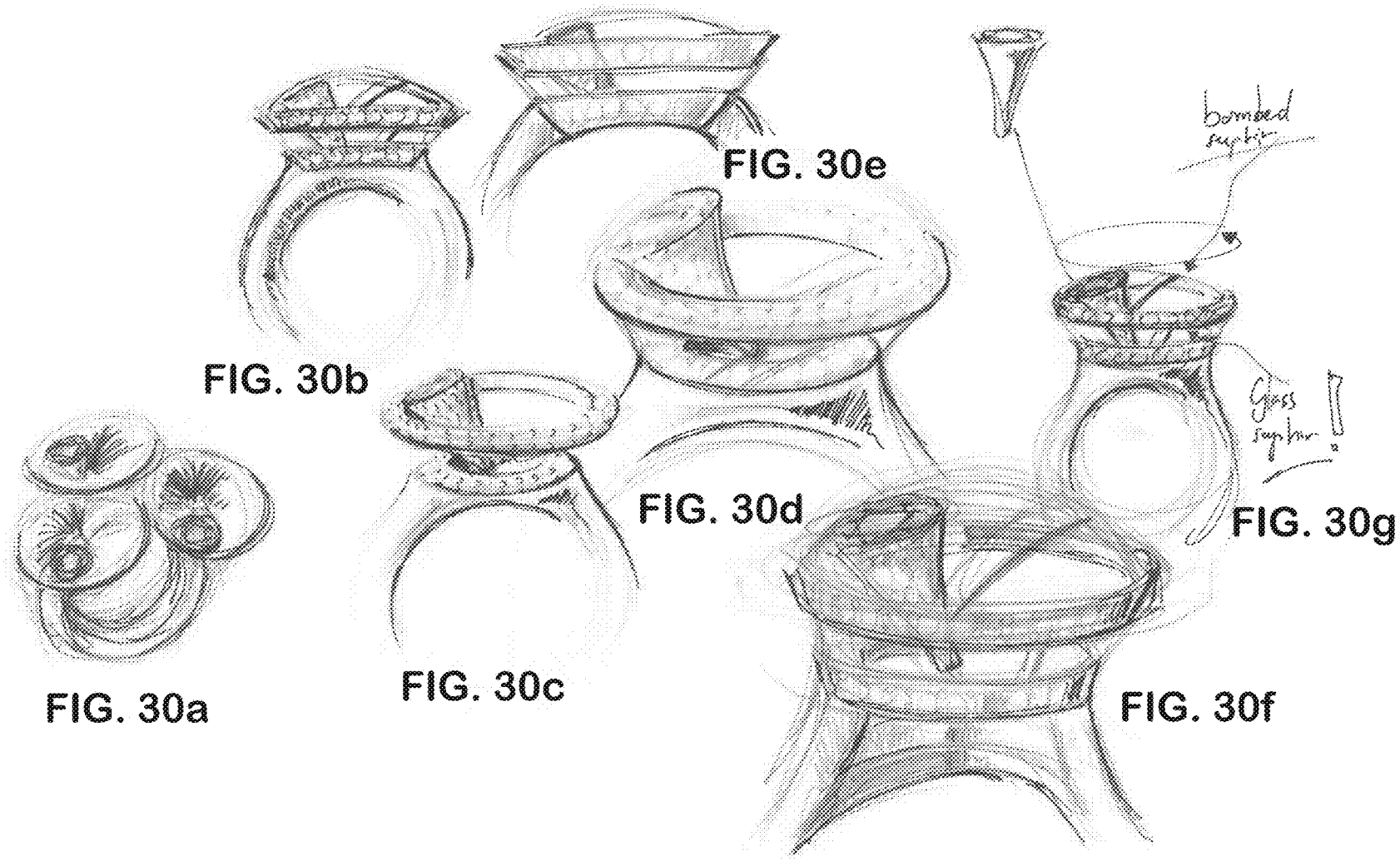
FIGS. 30*a*-30*g* show yet more sketches of various additional design variants.

According to FIGS. 29 and 30, the insert 8 with the disk 10 is arranged in conjunction with the use of articles of daily use of various types.

The direct or indirect movement of the gemstone mentioned several times above is understood to mean that the gemstone either executes a rolling and/or tilting movement directly in the liner or in a recess of the jewelry piece or that the holder which holds the gemstone executes these movements; because the gemstone is held in this holder, the gemstone itself executes these movements indirectly as a result of the movement of the holder.

The invention claimed is:

1. A jewelry piece, comprising:

a main body having a recess;

an insert set into the recess, the insert having a conical inner peripheral wall;

at least one gemstone inserted and movably supported in a recess in the main body, the at least one gemstone optionally set in a holder;

a cover that bounds at least parts of the recess, wherein at least parts of the cover are transparent, and the at least one gemstone or the holder for the at least one gemstone has a continuously conical outer contour, a longitudinal axis of the continuously conical outer contour is inclined relative to the conical inner peripheral wall of the insert, wherein the continuously conical outer contour is arranged to be rollable along the conical inner peripheral wall around the longitudinal axis of the outer contour.

2. The jewelry piece according to claim 1, wherein the insert and the cover are configured so that when the at least one gemstone is arranged in the insert there is substantially no gap between the at least one gemstone and a base of the insert and the cover.

3. The jewelry piece according to claim 1, further comprising a decorative element set into the inner peripheral wall or into a contact surface for contact with the cover.

4. The jewelry piece according to claim 1, wherein the cover is inserted into a radial expansion of the recess or of the insert.

5. The jewelry piece according to claim 4, wherein a transition, surface is formed between the inner peripheral wall and the radial expansion.

6. The jewelry piece according to claim 1, wherein the cover is an optical glass body.

7. The jewelry piece according to claim 1, wherein the cover has a flat shape.

8. The jewelry piece according to claim 1, wherein the cover has a curved shape.

9. The jewelry piece according to claim 1, wherein the insert comprises a conical outer contour.

10. The jewelry piece according to claim 1, wherein the body is a ring.

11. The jewelry piece according to claim 1, wherein the body is a pendant.

* * * * *